US012071957B1

(12) United States Patent
Yang et al.

(10) Patent No.: US 12,071,957 B1
(45) Date of Patent: Aug. 27, 2024

(54) HEAD MECHANISM AND FAN APPARATUS

(71) Applicant: GD MIDEA ENVIRONMENT APPLIANCES MFG CO., LTD., Zhongshan (CN)

(72) Inventors: Tao Yang, Zhongshan (CN); Shiqiang Cui, Zhongshan (CN); Junfeng Zeng, Zhongshan (CN); Runming Guo, Zhongshan (CN); Rihua Yu, Zhongshan (CN); Kai Huang, Zhongshan (CN); Sijin Ye, Zhongshan (CN)

(73) Assignee: GD MIDEA ENVIRONMENT APPLIANCES MFG CO., LTD., Zhongshan (CN)

( * ) Notice: Subject to any disclaimer, the term of this patent is extended or adjusted under 35 U.S.C. 154(b) by 0 days.

(21) Appl. No.: 18/456,504

(22) Filed: Aug. 27, 2023

(30) Foreign Application Priority Data

Mar. 23, 2023 (CN) ..... 202310292718.1

(51) Int. Cl.

| | |
|---|---|
| ***F04D 29/42*** | (2006.01) |
| ***F04D 25/06*** | (2006.01) |
| ***F04D 25/10*** | (2006.01) |
| ***F04D 29/44*** | (2006.01) |

(52) U.S. Cl.
CPC ..... *F04D 29/424* (2013.01); *F04D 25/0606* (2013.01); *F04D 25/10* (2013.01); *F04D 29/441* (2013.01)

(58) Field of Classification Search
CPC ..... F04D 29/424; F04D 25/10
See application file for complete search history.

(56) References Cited

U.S. PATENT DOCUMENTS

2020/0072498 A1* 3/2020 He ..... F24H 9/02

FOREIGN PATENT DOCUMENTS

| | | | | |
|---|---|---|---|---|
| DE | 102005006126 | A1 * | 3/2006 | ..... F04D 17/04 |
| JP | S55139299 | U | 10/1980 | |
| JP | S5724921 | U | 2/1982 | |
| JP | H0291644 | U | 7/1990 | |
| JP | 2019082274 | A | 5/2019 | |
| WO | 2020213031 | A1 | 10/2020 | |

OTHER PUBLICATIONS

Machine Translation of DE102005006126 (Year: 2006).*
OA received in JP Application No. 2023-116625; mailed May 14, 2024.

* cited by examiner

*Primary Examiner* — Brian O Peters

(57) ABSTRACT

Provided in embodiments of the present application are a head mechanism and a fan apparatus. The head mechanism includes: a casing, where a primary air inlet and an air outlet are provided on a circumferential side wall of the casing, and an auxiliary air inlet is provided on an axial wall surface of the casing; and a centrifugal volute arranged in the casing, where a centrifugal fan is arranged in the centrifugal volute, and an air duct outlet corresponding to the air outlet and an air duct inlet corresponding to the auxiliary air inlet are provided on the centrifugal volute; and air flowing from the primary air inlet and the auxiliary air inlet flows into the centrifugal volute through the air duct inlet. According to the embodiment of the present application, since the primary air inlet located on the circumferential side wall is provided.

18 Claims, 5 Drawing Sheets

HEAD MECHANISM AND FAN APPARATUS

CROSS-REFERENCES TO RELATED APPLICATIONS

The present application claims the priority to Chinese Patent Application No. "202310292718.1", filed with the China National Intellectual Property Administration on Mar. 23, 2023 and entitled "head mechanism and fan apparatus", which is incorporated in its entirety herein by reference.

FIELD

The present application relates to the field of fans, and in particular to a head mechanism and a fan apparatus.

BACKGROUND

Currently, it is typically required to place a circulating fan inside a space in the related art. However, in some use scenarios, when it is required to place the circulating fan against a wall or a corner, an air inflow amount will be limited, resulting in incapability to normally supply air.

SUMMARY

The present application aims to at least solve one of the problems in the prior art or the related art.

In view of this, an embodiment of the present application provides a head mechanism.

An embodiment of the present application provides a fan apparatus.

The embodiment of the present application provide the head mechanism. The head mechanism includes: a casing, where a primary air inlet and an air outlet are provided on a circumferential side wall of the casing, and an auxiliary air inlet is provided on an axial wall surface of the casing; and a centrifugal volute arranged in the casing, where a centrifugal fan is arranged in the centrifugal volute, and an air duct outlet corresponding to the air outlet and an air duct inlet corresponding to the auxiliary air inlet are provided on the centrifugal volute; and air flowing from the primary air inlet and the auxiliary air inlet flows into the centrifugal volute through the air duct inlet.

The head mechanism according to the present application mainly includes the casing and a centrifugal fan assembly. The centrifugal fan assembly is divided into the centrifugal volute and the centrifugal fan. The centrifugal volute is arranged in the casing, and inflow air and outflow air of air can be circulated by the air outlet and the primary air inlet on the casing. Since the centrifugal fan is used in the head mechanism of the solution and no fan blade is exposed outside, use safety during operation is greatly improved. It needs to be emphasized that in general, inflow air and outflow air of the centrifugal fan are configured with an angle of 90° therebetween, such as left inflow air, right inflow air and front outflow air. In the solution, an air inlet/outlet at the same position is provided on the casing on an outer side of the centrifugal volute. That is, the air outlet and the primary air inlet are both provided on a circumferential side wall of the casing. During production, the casing having the air outlet and the primary air inlet may be produced merely by machining the circumferential side wall of the casing. It needs to be noted that the primary air inlet and the auxiliary air inlet are provided on a circumferential wall surface and an axial wall surface of the casing respectively. Air flow may be blocked to some extent by mounting a motor inside the volute, and inflow air on two sides is seriously uniform. Or, when the head mechanism is placed against a wall or a corner, the auxiliary air inlet may be blocked by the wall, and an air inlet area of the auxiliary air inlet may not be fully utilized, to reduce an air amount, and affecting an air outflow effect. In the present application, the primary air inlet located in a circumferential direction of the casing is utilized to satisfy a required air inflow amount, and inflow air is more uniform. A position of a product is not affected by an environment, to greatly expand use scenarios.

The air outlet and the primary air inlet on the casing are both in communication with the centrifugal volute, and the centrifugal fan sucks air from the primary air inlet and discharges the air from the air outlet.

It needs to be noted that an air duct is formed in the centrifugal volute, an air duct outlet corresponds to the air outlet on the casing, and an air duct inlet corresponds to the auxiliary air inlet on the casing. Under the condition that the centrifugal fan rotates, air flows into the casing by the primary air inlet and the auxiliary air inlet, then flows into the centrifugal volute through the air duct inlet, and then is discharged outwards from the air duct outlet and the air outlet. It may be understood that part of the air flowing into the centrifugal volute through the air duct inlet flows by the primary air inlet, and the other part of the air flows by the auxiliary air inlet.

In the embodiment described above, the casing includes: a first support cover and a second support cover, where the first support cover and the second support cover are connected to form the air outlet and the primary air inlet; and the auxiliary air inlet is provided on an axial wall surface of the first support cover and/or an axial wall surface of the second support cover.

In the embodiment, the casing includes the first support cover and the second support cover that are separated from each other. After the first support cover and the second support cover are connected, the casing may be formed. That is, the air outlet and the primary air inlet are formed.

In an embodiment, a first support cover and a second support cover are provided with partial contour structures of an air outlet and a primary air inlet respectively.

In another embodiment, both an air outlet and a primary air inlet may be provided on a first support cover, or provided on a second support cover.

In another embodiment, one of an air outlet and a primary air inlet is provided on a first support cover, and the other one of the air outlet and the primary air inlet is provided on a second support cover.

In the embodiment described above, the head mechanism further includes: an air passing cover sleeving an outer side of the casing, where a first grid portion corresponding to the primary air inlet and/or a second grid portion corresponding to the air outlet are/is provided on the air passing cover.

In the embodiment, the air passing cover is arranged on the outer side of the casing. The air passing cover includes the first grid portion and/or the second grid portion, and air can be scattered when passing through the first grid portion or the second grid portion, to improve uniformity of outflow air.

In the embodiment described above, an extending direction of a blade of the centrifugal fan is not parallel to an extending direction of a grid of the second grid portion.

In the embodiment, the extending direction of the grid of the second grid portion is limited to be not parallel to the extending direction of the blade, and air flowing out through an air duct outlet can be scattered by the second grid portion, to improve uniformity of outflow air. It may be understood that if the extending direction of the blade is parallel to the extending direction of the grid of the second grid portion, a direction of outflow air flow may be obstructed, resulting in air amount loss.

Further, from the perspective of from the air outlet, the blade extends in a lateral direction, and the extending direction of the grid may be vertical or inclined, as long as an included angle may exist between the extending direction of the grid and the lateral direction to some extent.

In the embodiment described above, the extending direction of the blade of the centrifugal fan is perpendicular to the extending direction of the grid of the second grid portion.

In the embodiment, a relative position relation between the extending direction of the blade and the extending direction of the grid is perpendicular, and an obstruction influence on the outflow air flow can be reduced to the greatest extent to ensure an air amount of outflow air.

In the embodiment described above, on a section of an impeller of the centrifugal fan, a distance between the air duct outlet and a volute tongue of the centrifugal volute in a direction perpendicular to a vertical direction is less than 0.5 times a diameter of the impeller.

In the embodiment, a distance between the air duct outlet and the volute is limited, and air can maintain a high air speed by utilizing a short air duct, and a longer air supply distance can be achieved, and air circulation in an environment in which a product is located can be improved. In a further embodiment, on a section of the impeller, a lateral distance between a position of the air duct outlet and a volute tongue on the centrifugal volute needs to be less than 0.5 times a diameter of the impeller. That is, in a direction perpendicular to a vertical direction, a distance between the air duct outlet and the volute tongue is less than 0.5× the diameter of the impeller.

It may be understood that a position of the volute tongue is a minimum clearance between a wind wheel and the volute.

In the embodiment described above, on a section of an impeller of the centrifugal fan, a distance between a rotatable shaft of the impeller and the air duct outlet in a direction perpendicular to a vertical direction is 0.7 times to 1.3 times a diameter of the impeller.

In the embodiment, a size between an impeller and an air outlet of a volute in a centrifugal fan is limited, and a distance between an air duct outlet and a rotatable shaft of the impeller in a lateral direction is limited to be 0.7 times to 1.3 times a diameter of the impeller, and attenuation of an air speed at the air duct outlet is small, and an outward air speed is large, and a circulation effect can be improved.

In the embodiment described above, on a plane passing through a volute tongue of the centrifugal volute and one end of the air duct outlet farther from the volute tongue, a vertical distance between the air duct outlet and the plane is gradually increased from one end of the air duct outlet farther from the volute tongue to one end of the air duct outlet closer to the volute tongue.

In the embodiment, a shape of an air duct outlet is limited, and a reference plane is determined as a plane passing through a volute tongue in a centrifugal volute and one end of the air duct outlet farther from the volute tongue. The distance between the air duct outlet and the plane is limited. In a further embodiment, a vertical distance between the air duct outlet and the plane is gradually increased from one end of the air duct outlet farther from the volute tongue to one end of the air duct outlet closer to the volute tongue, to improve uniformity of outflow air. It may be understood that since a large amount of air flows out from a top of the air outlet in a traditional form, a length of an air duct at a bottom is increased by adjusting a position of a grid, to increase an outflow air amount at the bottom, and an effect of uniform outflow air in a vertical direction is achieved.

In the embodiment described above, on a section of the centrifugal fan, the air duct outlet has a contour protruding outwards.

In the embodiment, a shape of the air duct outlet is limited. The air duct outlet has a contour protruding outwards on a section of the centrifugal fan, and an outflow air amount at the bottom of the air duct outlet can be increased.

Further, a curvature of the contour of the air duct outlet is changed monotonically.

In an embodiment, a curvature of a contour of an air duct outlet at a top is less than that at a bottom.

In another embodiment, a curvature of a contour of an air duct outlet at a top is less than that at a bottom.

In the embodiment described above, the head mechanism further includes: a filter screen structure arranged corresponding to the primary air inlet and/or the auxiliary air inlet.

In the embodiment, a filter screen structure is arranged on at least one of the primary air inlet and the auxiliary air inlet, and air quality of an indoor environment can be optimally filtered during operation of a fan, and blown air is cleaner, to improve user experience.

Further, the filter screen structure may be a high efficiency particulate air (HEPA) filter screen, and impurities having a small particle size and some harmful substances in air may be filtered.

In the embodiment described above, an air passing cover is arranged on an outer side of the casing, a first grid portion corresponding to the primary air inlet is arranged on the air passing cover, and the filter screen structure and the first grid portion are correspondingly arranged on an outer side of the air passing cover.

In the embodiment, the air passing cover is arranged on an outer side of the casing. The first grid portion on the air passing cover is arranged corresponding to the primary air inlet, and air can be scattered when passing through the first grid portion, and air entering the centrifugal volute is more uniform.

In the solution, the filter screen structure is arranged on an outer side of the air passing cover, to facilitate operation when replacement is required. It may be understood that the filter screen structure belongs to a consumable structure. After a product operates for a period of time, a large amount of filtered dust may be accumulated on the filter screen structure, and the filter screen structure needs to be replaced. In the solution, the filter screen structure is arranged on the outer side of the air passing cover and is arranged corresponding to the primary air inlet, may be replaced by a user conveniently and rapidly.

In the embodiment described above, a mounting recess corresponding to the primary air inlet is provided on a circumferential side wall of the air passing cover, the head mechanism further includes: a cover plate grid detachably connected to the mounting recess, and the filter screen structure is arranged between the cover plate grid and the mounting recess.

In the embodiment, a mounting recess is provided on the air passing cover. A position of the mounting recess is a position corresponding to the primary air inlet on the circumferential side wall of the air passing cover, and the mounting recess is provided on a radial outer side of the primary air inlet. On this basis, by arranging a cover plate grid, the cover plate grid is grid-shaped, and air may circulate normally, and the filter screen structure can be limited and fixed. In some embodiments, since the cover plate grid is detachably connected to the mounting recess, the filter screen structure is convenient to replace.

It may be understood that detachable connection between the cover plate grid and the mounting recess includes, but not limited to, clamping, threaded connection, magnetic connection, etc.

In the embodiment described above, the head mechanism further includes: an outer plate arranged on one side of the casing in an axial direction, where an outer air inlet corresponding to the auxiliary air inlet is provided on the outer plate, and the outer air inlet includes first air inlet holes circumferentially arrayed.

In the embodiment, the outer plate is arranged outside an axial direction of the casing, and a preliminary scattering effect on inflow air can be achieved, and inflow of air is more uniform. In a further embodiment, the outer air inlet is provided on the outer plate, and the outer air inlet hole is provided in a hole shape. Under the condition that the centrifugal fan operates, air flows through the outer air inlet and flows into the centrifugal fan through the auxiliary air inlet, to complete air inflow.

It may be understood that a position of the outer air inlet corresponds to a position of the auxiliary air inlet. A specific corresponding relation includes, but not limited to, the outer air inlet and the auxiliary air inlet being provided at an interval in an axial direction.

Further, first air inlet holes are circumferentially arrayed, and air around the head mechanism, i.e. air from all directions, may flow into the centrifugal fan by the first air inlet holes.

In the embodiment described above, the outer plate includes: a first side plate arranged on one side of the first support cover farther away the second support cover; and a second side plate arranged on one side of the second support cover farther away the first support cover, where the outer air inlets corresponding to the auxiliary air inlets are provided on the first side plate and the second side plate.

In the embodiment, two outer plates, i.e. a first side plate and a second side plate, are arranged. In a further embodiment, the two side plates are arranged outside the two support covers. That is, the first side plate is arranged outside the first support cover, the second side plate is arranged outside the second support cover, and corresponding outer air inlets are provided on the two side plates, and air may flow from the outer air inlets on the two side plates into an auxiliary air inlet on a casing, to complete air inflow.

In the embodiment described above, the first side plate is in buckled connection to the air passing cover; and/or the second side plate is in buckled connection to the air passing cover.

In the embodiment, at least one of a first side plate and a second side plate is in buckled connection to an air passing cover, and no screws or other exposed connection members are exposed on an outer side of a whole product. Under the condition that both the first side plate and the second side plate are clamped to the air passing cover, the first side plate, the second side plate and the air passing cover may form a whole.

Further, the first side plate and the second side plate are in buckled connection to an edge of the air passing cover in a circumferential direction.

In the embodiment described above, in a radial direction, hole diameters of the first air inlet holes are gradually reduced from inside to outside.

In the embodiment, hole diameters of first air inlet holes are gradually reduced from inside to outside in a radial direction. The first air inlet holes closer to an inner side have a larger hole diameter, and the first air inlet holes closer to an outer side have a smaller hole diameter. On one hand, the first air inlet holes having different hole diameters are used, and frequencies of noise sources are changed, a superposition phenomenon of a fundamental frequency is avoided, and noise can be effectively reduced. On the other hand, the first air inlet holes closer to the outer side have a smaller hole diameter and a smaller air inflow amount, and the first air inlet holes closer to the inner side have a larger hole diameter and a larger air inflow amount, and air inflow speeds at radial positions are as consistent as possible, to improve uniformity of inflow air.

In the embodiment described above, first air inlet holes having the same radius on the outer plate have the same hole diameter.

In the embodiment, the hole diameter of the first air inlet holes located at the same radius on the outer plate is limited. The first air inlet holes at the same radius have the same hole diameter, and on one hand, machining is facilitated, and on the other hand, when air flows to the same radius, an air inflow amount flowing through the first air inlet hole is more uniform.

It may be understood that a center of the same radius is an axis around which the first air inlet holes are circumferentially arrayed, which is a rotatable shaft of a centrifugal fan in general.

In the embodiment described above, the outer plate includes a recessed plate, where the first air inlet hole is provided on the recessed plate.

In the embodiment, the outer plate is recessed. The first air inlet hole is provided on the recessed plate, and impact of air during negative pressure air inlet can be effectively reduced. The recessed plate may have an effect of flow guide on air to some extent. In some embodiments, a Coanda effect is utilized, and air tends to flow along a wall surface, to improve air inflow efficiency.

In the embodiment described above, the recessed plate is recessed towards the centrifugal volute, and an outer wall surface of the recessed plate is curved on a section passing through a rotatable shaft of the centrifugal fan.

In the embodiment, a recessed direction of the recessed plate is recessed inwards, i.e., recessed towards a centrifugal volute. The recessed plate is a curved surface, and a process of air flowing into the first air inlet hole along a surface of the recessed plate is smoother. A curved surface structure may effectively improve an air guide effect and air inflow efficiency without increasing a wind resistance.

In the embodiment described above, on a section passing through a rotatable shaft of the centrifugal fan, an included angle between an outer wall surface of the recessed plate and a vertical direction is not greater than 30°.

In the embodiment, an included angle c between an outer wall surface of the recessed plate and the vertical direction is limited to be less than 30°. A recessed angle of the recessed plate is small, and a steering direction of air is gentle, to reduce possibility of generating noise. In some embodiments, a guide effect is more obvious, and spatial arrangement of a structure and an air guide effect on air may further be ensured.

In the embodiment described above, the auxiliary air inlet includes second air inlet holes circumferentially arrayed.

In the embodiment, the auxiliary air inlet on the casing is in a hole-shaped structure. That is, the auxiliary air inlet includes circumferential arrayed second air inlet holes.

Under the action of the second air inlet hole, when air flows to the auxiliary air inlet through an outer air inlet, air may be scattered for the second time, and air flowing into the centrifugal volute is more sufficient and uniform.

Further, the second air inlet holes are circumferentially arrayed, and air flows into a space between the outer air inlet and the auxiliary air inlet by the first air inlet hole, and air from all directions may flow by the second air inlet hole.

Further, each first air inlet hole is provided opposite the second air inlet hole.

In an embodiment, the first air inlet hole and the second air inlet hole are provided in a staggered manner.

In the embodiment described above, the second air inlet holes have the same hole diameter.

In the embodiment, hole diameters of the second air inlet holes are limited. The second air inlet holes have the same hole diameter, and are convenient to machine. After air is scattered by the first air inlet hole, a difference of an air inflow amount at each radius is small, and the hole diameter of the second air inlet hole at an inner side is not changed, and the air inflow amount can be ensured.

In the embodiment described above, in a radial direction, hole diameters of the second air inlet holes are gradually reduced from inside to outside.

In the embodiment, hole diameters of the second air inlet holes are gradually reduced from inside to outside in the radial direction. The second air inlet holes closer to an inner side have a larger hole diameter, and the second air inlet holes closer to an outer side have a smaller hole diameter. On one hand, the second air inlet holes having different hole diameters are used, and frequencies of noise sources are changed, a superposition phenomenon of a fundamental frequency is avoided, and noise can be effectively reduced. On the other hand, the second air inlet holes closer to the outer side have a smaller hole diameter and a smaller air inflow amount, and the second air inlet holes closer to the inner side have a larger hole diameter and a larger air inflow amount, and air inlet speeds at radial positions are as consistent as possible, to improve uniformity of inflow air.

In the embodiment described above, the auxiliary air inlets are provided on axial wall surfaces of two ends of the casing in an axial direction respectively.

In the embodiment, the auxiliary air inlet is provided on an end surface, i.e., an axial wall surface, of the casing, to increase an air inflow amount of the centrifugal fan. It may be understood that on the basis of the primary air inlet, two auxiliary air inlets are additionally provided, and during air inflow, air can be inlet inwards from three directions of the casing, and it is more convenient to satisfy use requirements of a large air amount.

It may be understood that the auxiliary air inlet needs to be in communication with the centrifugal volute, to facilitate air inlet.

In the embodiment described above, the primary air inlet and the air outlet are provided at an interval in a circumferential direction of the casing, and an angle between one end of the air outlet closer to the primary air inlet and one end of the primary air inlet closer to the air outlet relative to a rotatable shaft of the centrifugal fan is not less than 30°.

In the embodiment, since the primary air inlet and the air outlet are both provided in a circumferential direction of the casing, an effect of supplementing an inflow air amount can be achieved. In a further embodiment, an included angle b between a straight line of one end of the air outlet closer to the primary air inlet relative to a rotatable shaft of the centrifugal fan and a straight line of one end of the air inlet closer to the air outlet relative to the rotatable shaft of the centrifugal fan are not less than 30°, and there is a gap limitation between the primary air inlet and the air outlet to some extent, and air flowing out through the air outlet may not directly return to the primary air inlet, to ensure an effect of air supply.

In the embodiment described above, an angle between one end of the air outlet closer to the primary air inlet and one end of the primary air inlet farther away the air outlet relative to a rotatable shaft of the centrifugal fan is not greater than 150°.

In the embodiment, the farthest position between the primary air inlet and the air outlet is limited. That is, an angle a between one end of the air outlet closer to the primary air inlet and one end of the primary air inlet farther away the air outlet relative to the rotatable shaft of the centrifugal fan is not greater than 150°, to fully utilize inflow air at a position having the highest air inflow efficiency in the centrifugal volute, and improve air inflow efficiency.

In the embodiment described above, an angle between two circumferential ends of the primary air inlet relative to a rotatable shaft of the centrifugal fan is 100° to 130°.

In the embodiment, a circumferential position of the primary air inlet is limited, and central angles corresponding to two ends of the primary air inlet are limited to be 100° to 130°, and on one hand, an air inlet resistance of the whole head mechanism can be reduced to fully utilize air at a bottom, and greatly increase an air inflow amount; and on the other hand, the primary air inlet is prevented from being too large, to ensure a position of the air outlet and an air supply distance.

In the embodiment described above, in a direction of rotation of the centrifugal fan, the air outlet is located in front of the primary air inlet.

In the embodiment, relative positions of the air outlet and the primary air inlet are limited. Under the condition that the centrifugal fan normally discharges air and rotates, the air outlet is located in front of the primary air inlet in a direction of rotation of the centrifugal fan. That is, when the centrifugal fan rotates anticlockwise, the air outlet is located on an upper side of the primary air inlet, and when the centrifugal fan rotates clockwise, the air outlet is located on a lower side of the primary air inlet. Air is prevented from passing through the primary air inlet, and the air outlet is provided at the primary air inlet, to improve air inflow efficiency.

In the embodiment described above, the auxiliary air inlet has an air inlet area less than that of the primary air inlet.

In the embodiment, air inlet areas of two air inlets are limited. The air inlet area of the primary air inlet is limited to be larger, and the air inlet area of the auxiliary air inlet is limited to be smaller, and the primary air inlet can be fully utilized to achieve inflow of a large amount of air. In some embodiments, hidden air inflow may further be achieved according to a position of the primary air inlet.

In the embodiment described above, the head mechanism further includes: a guide member arranged at one end of the casing in an axial direction, where a guide plate is arranged on one side of the guide member facing the casing, air flows into the casing by the guide plate and the recessed plate, and an included angle between the guide plate and a vertical direction is 60° to 90°.

In the embodiment, the guide member is arranged at each of two axial ends of the head mechanism. Since the guide plate is arranged on the guide member, an air inflow space is formed under the combined action of the guide plate and the recessed plate, and air flows into the casing from the air inflow space.

An angle of inclination d of the guide plate relative to a vertical direction is 60° to 90°, and sufficient air can flow into an air inflow space.

Further, the guide member may directly serve as a housing of a rotating support.

In the embodiment described above, an included angle between a tangent of one end of the guide plate farther away the head mechanism and the vertical direction is less than 40°.

In the embodiment, an inlet angle of the guide plate is limited. That is, an included angle e of a tangent of one end of the guide plate farther away the head mechanism relative to the vertical direction is limited to be less than 40°, and impact of inflow air from the auxiliary air inlet can be reduced, and air inflow efficiency can be improved.

The embodiment of the present application provides the fan apparatus. The fan apparatus includes: a floor stand, where a guide member is formed at a top of the floor stand; and any one of head mechanism of the embodiments described above that is arranged on the floor stand.

The fan apparatus according to the present application includes the floor stand and the head mechanism, where the floor stand may support the head mechanism. The fan apparatus is in a shape of a floor fan as a whole, and has a height of outflow air that is in line with a use habit of a user.

It needs to be emphasized that in the present application, a guide member is formed at a top of the floor stand, and an end structure of the floor stand extending upwards is utilized to match a recessed plate on the head mechanism, and air flows into the head mechanism from a position between the end structure and the recessed plate.

Since the fan apparatus includes the head mechanism, the fan apparatus has the beneficial effects of any one of the head mechanism in the embodiment of the embodiments described above, which will not be repeated herein.

The fan apparatus includes, but not limited to, a floor fan, a tower fan, a circulating fan, etc.

Further, a primary air inlet is provided on one side of a casing close to the floor stand. That is, the primary air inlet is provided on one side of the casing facing downwards to reduce appearance integrity of the fan apparatus at a visible angle to the greatest extent. That is, the primary air inlet is close to a lower side of the floor stand and is less likely to be observed by a user.

In the embodiment described above, the fan apparatus further includes: a driving mechanism, where at least part of the driving mechanism is arranged in the guide member, and the driving mechanism includes: a first support member connected to the floor stand; and a rotating motor arranged on the first support member, where a driving end of the rotating motor is connected to a second support member, and the second support member is connected to the head mechanism; and/or a rotating mechanism, where at least part of the rotating mechanism is arranged in the guide member, where the rotating mechanism and the driving mechanism are arranged on two opposite sides of the head mechanism in an axial direction.

In the embodiment, the driving mechanism is arranged, and the head mechanism can be driven to swing. For example, the head mechanism can be driven to swing left and right, or the head mechanism can be driven to swing in a pitching manner. In a further embodiment, the driving mechanism includes a first support member, a rotating motor and a second support member. The first support member and the second support member are arranged on two sides of the rotating motor respectively, the first support member is configured to be connected to the floor stand, and the second support member is configured to be connected to the head mechanism. Under the action of the rotating motor, the head mechanism may swing relative to the floor stand.

It needs to be noted that at least part of the driving mechanism configured to drive the head mechanism to rotate is arranged in a guide member, and an inner space of the guide member is utilized to give consideration to both internal rotary drive and air inlet flow guide of an outer surface.

In the embodiment described above, the head mechanism further includes: a rotating mechanism, where at least part of the rotating mechanism is arranged in the guide member, and the rotating mechanism and the driving mechanism are arranged on two opposite sides of the head mechanism in an axial direction.

In the embodiment, the rotating mechanism is arranged on the floor stand, and the rotating mechanism is arranged on the other side of the head mechanism. The rotating mechanism mainly has an effect of auxiliary support, to effectively support and rotate the head mechanism under the combined action of the driving mechanism. In some embodiments, air can be fully circulated by relative swing, to improve a purification effect.

It needs to be noted that at least part of the rotating mechanism configured to match the driving mechanism is arranged in the guide member, and the inner space of the guide member is utilized to ensure both internal rotary drive and air inlet flow guide of the outer surface.

Further, the rotating mechanism and the driving mechanism are arranged on two axial sides of the head mechanism, to adjust the head mechanism in a pitching manner.

It may be understood that the rotating mechanism and the driving mechanism are arranged in the guide member, and when the head mechanism is controlled to pitch and rotate, a flow guide effect on inflow of air is not influenced, and surrounding air does not make contact with the rotating mechanism on an inflow path, to ensure smooth inflow.

In the embodiment described above, a rotatable shaft of the rotating mechanism and/or the driving mechanism is located in a center of a recessed plate of the head mechanism; and a first air inlet hole of the head mechanism is provided around the rotatable shaft of the rotating mechanism.

In the embodiment, a position of the rotatable shaft is limited. At least one of the rotatable shaft of the rotating mechanism and the rotatable shaft of the driving mechanism is arranged in a center of a recessed plate of the head mechanism. On this basis, a first air inlet hole is limited, and the first air inlet hole is limited to be provided around the rotatable shaft, and air may uniformly flow into the head mechanism by the first air inlet hole, to achieve air inlet.

In the embodiment described above, the head mechanism further includes: a rotating support, where the rotating support includes connectors arranged on two axial sides of a casing of the head mechanism, the casing is rotatably connected to the rotating support by the connector, and a wire of a centrifugal fan is led out by the connector on one side of the rotating support.

In the embodiment, the rotating support is arranged, and the head mechanism may shake and rotate. The rotating support includes connectors. The two connectors are arranged on two axial sides of the casing. The casing can be rotatably connected to the rotating support by the connector, and pitch shaking or lateral swing of the head mechanism can be achieved. On this basis, since the centrifugal fan needs to be powered on, arrangement of a wire is limited to some extent when the centrifugal fan rotates. In the solution, the connector is directly utilized to make the wire extend along the connector, to be led out to supply power to the centrifugal fan.

It needs to be noted that the rotating support is Y-shaped as a whole, and a size of the head mechanism cannot be greatly limited.

In the embodiment described above, a primary air inlet of the head mechanism is provided around a rotatable shaft of the rotating support.

In the embodiment, the primary air inlet is directly provided around the rotatable shaft of the rotating support. That is, a first air inlet hole may avoid a fulcrum position when arranged, to reduce an influence of a fulcrum on an air inflow amount, and improving air inflow efficiency.

In the embodiment described above, the head mechanism further includes: a rotating motor arranged on the connector on one side of the casing, where the rotating motor is connected to the casing, to drive the casing to rotate relative to the rotating support.

In the embodiment, the rotating motor is arranged on the connector on one side of the casing, and may drive the casing to rotate.

In the embodiment described above, the centrifugal fan includes: a driving motor and an impeller that are in transmission connection, where the rotating motor and the driving motor are arranged on two opposite sides of the casing.

In the embodiment, the centrifugal fan includes the driving motor and the impeller. The driving motor may drive the impeller to rotate, to supply air outwards. In the solution, positions of the rotating motor and the driving motor are limited, and the rotating motor and the driving motor are limited to be arranged on two opposite sides of the casing, and a center of gravity of a whole product is close to a central axis to maintain structural stability.

In the embodiment described above, the head mechanism further includes: a wire passing hole provided on one of the two connectors located on the same side of the casing as the driving motor, where a wire of the centrifugal fan is led out by the wire passing hole.

In the embodiment, the wire passing hole is provided on the connector to lead a wire of the centrifugal fan out. Since a form of the wire passing hole is used, the wire can be led out from inside to outside, and then is connected to a controller or a power supply.

In the embodiment described above, the head mechanism further includes: a wire passing recess provided on the rotating support.

In the embodiment, the wire passing recess is provided on the rotating support, and the wire can be placed in the wire passage recess. The wire passing recess provides a space for the wire and achieves structural protection, and the wires is hidden in the wire passing recess to ensure a smooth circuit.

In the embodiment described above, the head mechanism further includes: a limiting buckle arranged on the wire passing recess, where the limiting buckle is configured to limit the wire.

In the embodiment, the limiting buckle is provided on the wire passing recess, and the wire can be limited, and is prevented from falling into the head mechanism after falling off, and use safety is improved.

In the embodiment described above, on a circumferential side wall of the casing, a distance between the wire passing hole or the wire passing recess and a rotatable shaft of the impeller is less than 200 mm.

In the embodiment, if the distance between any one of the wire passing hole and the wire passing recess and a rotatable shaft of an impeller is within 200 mm, a path of the wire is closer to a center, to lead the wire out.

Additional embodiments of the present application will become apparent in the following description, or can be learned by practice of the present application.

Figure 1:
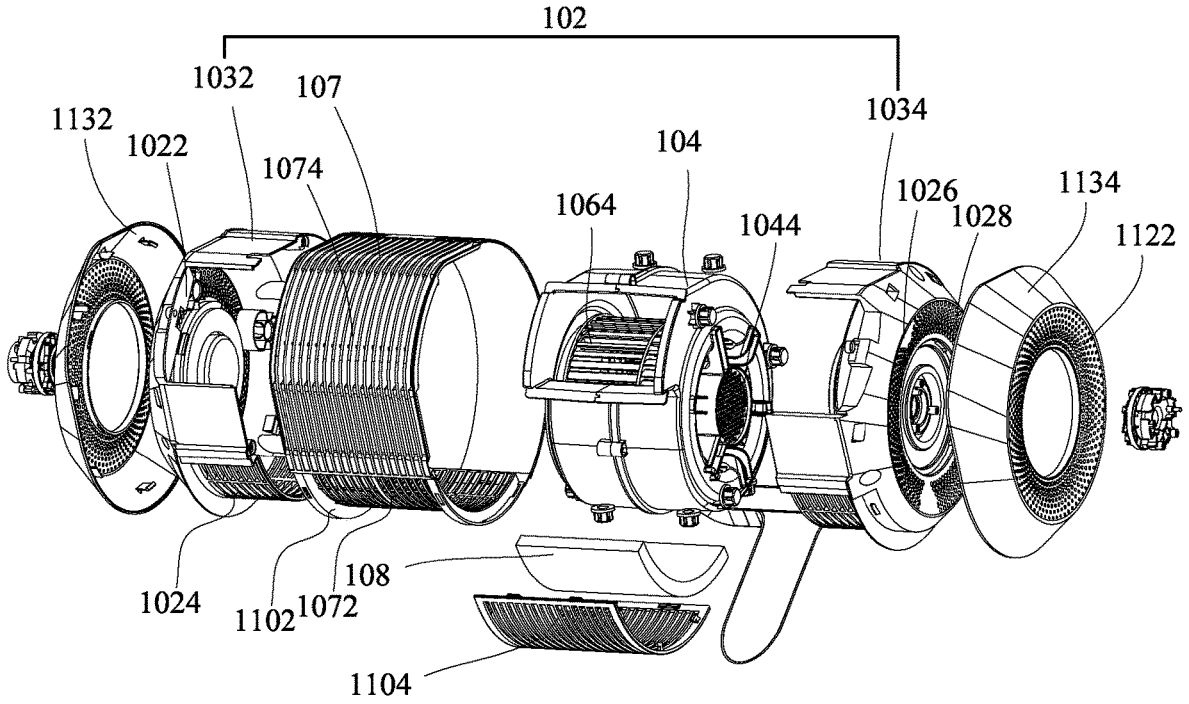
FIG. 1 shows a schematic structural diagram of a head mechanism according to an embodiment of the present application.

Corresponding relations between reference numerals and component names in FIGS. 1 to 11 are as follows:

100: head mechanism; 102: casing; 1022: air outlet; 1024: primary air inlet; 1026: auxiliary air inlet; 1028: second air inlet hole; 1032: first support cover; 1034: second support cover; 104: centrifugal volute; 1042: air duct outlet; 1044: air duct inlet; 106: centrifugal fan; 1062: driving motor; 1064: impeller; 107: air passing cover; 1072: first grid portion; 1074: second grid portion; 108: filter screen structure; 1102: mounting recess; 1104: cover plate grid; 112: outer plate; 1122: outer air inlet; 1124: recessed plate; 126: first air inlet hole; 1132: first side plate; 1134: second side plate;

200: fan apparatus; 202: floor stand; 204: driving mechanism; 2042: first support member; 2046: second support member; 206: rotating mechanism; 208: guide member; 2082: guide plate; 210: rotating support; 2102: connector; 2104: wire passing hole; 2106: wire passing recess; 2108: limiting buckle; and 212: rotating motor.

DETAILED DESCRIPTION OF THE DISCLOSURE

The embodiments of the present application will be further described in detail below with reference to the accompanying drawings and the specific implementations. It should be noted that the embodiments in the present application and features in the embodiments can be combined with one another without conflict.

Many specific details are set forth in the following description to facilitate full understanding of the present application, but the embodiments of the present application may further be implemented in other ways different from those described herein, and therefore the scope of protection of the present application is not limited by the particular embodiments disclosed below.

Some embodiments according to the present application will be described below with reference to FIGS. 1 to 11.

As shown in FIG. 1, a head mechanism 100 according to the embodiment mainly includes a casing 102 and a centrifugal fan assembly. The centrifugal fan assembly is divided into a centrifugal volute 104 and a centrifugal fan 106. The centrifugal volute 104 is arranged in the casing 102, and inflow air and outflow air of air can be circulated by an air outlet 1022 and a primary air inlet 1024 on the casing 102. Since the centrifugal fan 106 is used in the head mechanism 100 of the solution and no fan blade is exposed outside, use safety during operation is greatly improved. It needs to be emphasized that in general, inflow air and outflow air of the centrifugal fan 106 are configured with an angle of 90° therebetween, such as left inflow air, right inflow air and front outflow air. In the solution, an air inlet/outlet 1022 at the same position is provided on the casing 102 on an outer side of the centrifugal volute 104. That is, the air outlet 1022 and the primary air inlet 1024 are both provided on a circumferential side wall of the casing 102. During production, the casing 102 having the air outlet 1022 and the primary air inlet 1024 may be produced merely by machining the circumferential side wall of the casing 102. It needs to be noted that the primary air inlet 1024 and an auxiliary air inlet 1026 are provided on a circumferential wall surface and an axial wall surface of the casing 102 respectively. Air flow may be blocked to some extent by mounting a motor inside the volute, and inflow air on two sides is seriously uniform. Or, when the head mechanism 100 is placed against a wall or a corner, the auxiliary air inlet 1026 may be blocked by the wall, and an air inlet area of the auxiliary air inlet 1026 may not be fully utilized, to reduce an air amount, and affecting an air outflow effect. In the present application, the primary air inlet 1024 located in a circumferential direction of the casing 102 is utilized to satisfy a required air inflow amount, and inflow air is more uniform. A position of the product is not affected by an environment, to greatly expand use scenarios.

The head mechanism 100 is annular as a whole, and may be partially protruding on the basis of a cylinder as shown in FIG. 1.

The air outlet 1022 and the primary air inlet 1024 on the casing 102 are both in communication with the centrifugal volute 104, and the centrifugal fan 106 sucks air from the primary air inlet 1024 and discharges the air from the air outlet 1022.

Figure 2:
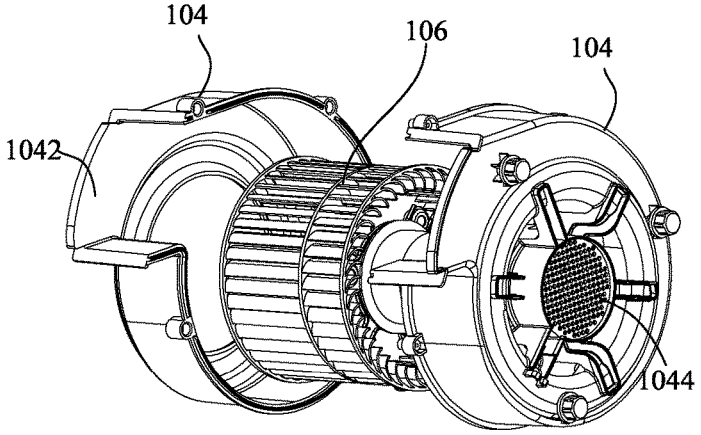
FIG. 2 shows a schematic structural diagram of a centrifugal volute and an impeller according to an embodiment of the present application.

It needs to be noted that as shown in FIG. 2, in general, inflow air and outflow air of a centrifugal fan 106 are configured with an angle of 90° therebetween, such as left inflow air, right inflow air and front outflow air. In the solution, an air inlet/outlet 1022 at the same position is provided on a casing 102 on an outer side of a centrifugal volute 104. That is, an air outlet 1022 and a primary air inlet 1024 are both provided on a circumferential side wall of the casing 102. During production, a casing 102 structure having the air outlet 1022 and the primary air inlet 1024 may be produced merely by machining the circumferential side wall of the casing 102. It needs to be noted that the primary air inlet 1024 and an auxiliary air inlet 1026 are provided on a circumferential wall surface and an axial wall surface of the casing 102 respectively. An air duct is formed in the centrifugal volute 104, an air duct outlet 1042 corresponds to the air outlet 1022 on the casing 102, and an air duct inlet 1044 corresponds to the auxiliary air inlet 1026 on the casing 102. Under the condition that the centrifugal fan 106 rotates, air flows into the casing 102 by the primary air inlet 1024 and the auxiliary air inlet 1026, then flows into the centrifugal volute 104 through the air duct inlet 1044, and then is discharged outwards from the air duct outlet 1042 and the air outlet 1022. It may be understood that part of the air flowing into the centrifugal volute 104 through the air duct inlet 1044 flows by the primary air inlet 1024, and the other part of the air flows by the auxiliary air inlet 1026.

The casing 102 includes a first support cover 1032 and a second support cover 1034 that are separated from each other. After the first support cover 1032 and the second support cover 1034 are connected, the casing 102 may be formed. That is, the air outlet 1022 and the primary air inlet 1024 are formed.

In an embodiment, a head mechanism 100 mainly includes a casing 102 and a centrifugal fan assembly. The centrifugal fan assembly is divided into a centrifugal volute 104 and a centrifugal fan 106. The centrifugal volute 104 is arranged in the casing 102, and inflow air and outflow air of air can be circulated by an air outlet 1022 and a primary air inlet 1024 on the casing 102. Since the centrifugal fan 106 is used in the head mechanism 100 of the solution and no fan blade is exposed outside, use safety during operation is greatly improved. It needs to be emphasized that in general, inflow air and outflow air of the centrifugal fan 106 are configured with an angle of 90° therebetween, such as left inflow air, right inflow air and front outflow air. In the solution, an air inlet/outlet 1022 at the same position is provided on the casing 102 on an outer side of the centrifugal volute 104. That is, the air outlet 1022 and the primary air inlet 1024 are both provided on a circumferential side wall of the casing 102. During production, a casing 102 structure having the air outlet 1022 and the primary air inlet 1024 can be produced merely by machining the circumferential side wall of the casing 102. On this basis, a first support cover 1032 and a second support cover 1034 are provided with partial contour structures of the air outlet 1022 and the primary air inlet 1024 respectively.

In another embodiment, it needs to be emphasized that in general, inflow air and outflow air of a centrifugal fan 106 are configured with an angle of 90° therebetween, such as left inflow air, right inflow air and front outflow air. In the solution, an air inlet/outlet 1022 at the same position is provided on a casing 102 on an outer side of a centrifugal volute 104. That is, an air outlet 1022 and a primary air inlet 1024 are both provided on a circumferential side wall of the casing 102. During production, the casing 102 having the air outlet 1022 and the primary air inlet 1024 may be produced merely by machining the circumferential side wall of the casing 102. On this basis, both the air outlet 1022 and the primary air inlet 1024 may be provided on a first support cover 1032, or provided on a second support cover 1034.

In another embodiment, it needs to be emphasized that in general, inflow air and outflow air of a centrifugal fan 106 are configured with an angle of 90° therebetween, such as left inflow air, right inflow air and front outflow air. In the solution, an air inlet/outlet 1022 at the same position is provided on a casing 102 on an outer side of a centrifugal volute 104. That is, an air outlet 1022 and a primary air inlet 1024 are both provided on a circumferential side wall of the casing 102. During production, the casing 102 having the air outlet 1022 and the primary air inlet 1024 may be produced merely by machining the circumferential side wall of the casing 102. On this basis, one of the air outlet 1022 and the primary air inlet 1024 is provided on a first support cover 1032, and the other one of the air outlet and the primary air inlet is provided on a second support cover 1034.

As shown in FIG. 1, an air passing cover 107 is arranged on an outer side of the casing 102. The air passing cover 107 includes a first grid portion 1072 and a second grid portion 1074, and air may be scattered when passing through the first grid portion 1072 or the second grid portion 1074, to improve uniformity of outflow air.

It needs to be noted that an extending direction of a grid of the second grid portion 1074 is not parallel to an extending direction of a blade, and air flowing out through an air duct outlet 1042 may be scattered by the second grid portion 1074, to improve uniformity of outflow air. It may be understood that if the extending direction of the blade is parallel to the extending direction of the grid of the second grid portion 1074, a direction of outflow air flow may be obstructed, resulting in air amount loss.

Further, from the perspective of the air outlet 1022, the blade extends in a lateral direction, and the extending direction of the grid may be vertical or inclined, as long as an included angle may exist between the extending direction of the grid and the lateral direction to some extent.

In a further embodiment, a relative position relation between the extending direction of the blade and the extending direction of the grid is perpendicular, and an obstruction influence on the outflow air flow may be reduced to the greatest extent to ensure an air amount of outflow air.

In addition, a distance between the air duct outlet 1042 and the volute is limited, and air can maintain a high air speed by utilizing a short air duct, and a longer air supply distance can be achieved, and air circulation in an environment in which a product is located can be improved. On a section of an impeller 1064, a lateral distance between a position of the air duct outlet 1042 and a volute tongue on the centrifugal volute 104 needs to be less than 0.5 times a diameter of the impeller 1064. That is, in a direction perpendicular to a vertical direction, a distance between the air duct outlet 1042 and the volute tongue is less than 0.5×the diameter of the impeller.

It may be understood that a position of the volute tongue is a minimum clearance between a wind wheel and the volute.

In a particular embodiment, a size between an impeller 1064 and an air outlet 1022 of a volute in a centrifugal fan 106 is limited, and a distance between an air duct outlet 1042 and a rotatable shaft of the impeller 1064 in a lateral direction is limited to be 0.7 times to 1.3 times a diameter of the impeller 1064, and attenuation of an air speed at the air duct outlet 1042 is small, and an outward air speed is large, and a circulation effect may be improved. It needs to be emphasized that in general, inflow air and outflow air of the centrifugal fan 106 are configured with an angle of 90° therebetween, such as left inflow air, right inflow air and front outflow air. In the solution, an air inlet/outlet 1022 at the same position is provided on the casing 102 on an outer side of the centrifugal volute 104. That is, the air outlet 1022 and the primary air inlet 1024 are both provided on a circumferential side wall of the casing 102. During production, a casing 102 structure having the air outlet 1022 and the primary air inlet 1024 can be produced merely by machining the circumferential side wall of the casing 102. It needs to be noted that the primary air inlet 1024 and an auxiliary air inlet 1026 are provided on a circumferential wall surface and an axial wall surface of the casing 102 respectively.

Figure 5:
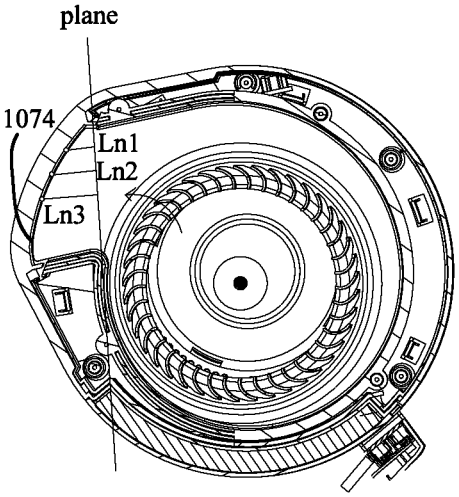
FIG. 5 shows a schematic structural diagram of a section of a head mechanism according to an embodiment of the present application.

In the embodiment, a shape of the air duct outlet 1042 is further limited. As shown in FIG. 5, in a rough direction from top to bottom, a distance Ln between an air duct outlet 1042 and a plane is gradually increased, i.e. Ln1<Ln2<Ln3. The air duct outlet 1042 extends as a whole from top to bottom in a transitional manner. On this basis, a reference plane is determined as a plane passing through a volute tongue in a centrifugal volute and one end of the air duct outlet farther from the volute tongue. The distance between the air duct outlet and the plane is limited. A vertical distance between the air duct outlet and the plane is gradually increased from one end of the air duct outlet farther from the volute tongue to one end of the air duct outlet closer to the volute tongue, to improve uniformity of outflow air. It may be understood that since a large amount of air flows out from a top of the air outlet in a traditional form, a length of an air duct at a bottom is increased by adjusting a position of a grid, to increase an outflow air amount at the bottom, and an effect of uniform outflow air in a vertical direction is achieved.

Further, a head mechanism 100 mainly includes a casing 102 and a centrifugal fan assembly. The centrifugal fan assembly is divided into a centrifugal volute 104 and a centrifugal fan 106. The centrifugal volute 104 is arranged in the casing 102, and inflow air and outflow air of air can be circulated by an air outlet 1022 and a primary air inlet 1024 on the casing 102. Since the centrifugal fan 106 is used in the head mechanism 100 of the solution and no fan blade is exposed outside, use safety during operation is greatly improved. It needs to be emphasized that in general, inflow air and outflow air of the centrifugal fan 106 are configured with an angle of 90° therebetween, such as left inflow air, right inflow air and front outflow air. In the solution, an air inlet/outlet 1022 at the same position is provided on the casing 102 on an outer side of the centrifugal volute 104. That is, the air outlet 1022 and the primary air inlet 1024 are both provided on a circumferential side wall of the casing 102. During production, a casing 102 structure having the air outlet 1022 and the primary air inlet 1024 can be produced merely by machining the circumferential side wall of the casing 102. A shape of the air duct outlet 1042 is limited. The air duct outlet 1042 has a contour protruding outwards on a section of the centrifugal fan 106, and an outflow air amount at the bottom of the air duct outlet 1042 may be increased.

Further, a curvature of the contour of the air duct outlet 1042 is changed monotonically.

In an embodiment, in general, inflow air and outflow air of a centrifugal fan 106 are configured with an angle of 90° therebetween, such as left inflow air, right inflow air and front outflow air. In the solution, an air inlet/outlet 1022 at the same position is provided on a casing 102 on an outer side of a centrifugal volute 104. That is, an air outlet 1022 and a primary air inlet 1024 are both provided on a circumferential side wall of the casing 102. During production, the casing 102 having the air outlet 1022 and the primary air inlet 1024 may be produced merely by machining the circumferential side wall of the casing 102. A curvature of a contour of an air duct outlet 1042 at a top is less than that at a bottom.

In another embodiment, it needs to be emphasized that in general, inflow air and outflow air of a centrifugal fan 106 are configured with an angle of 90° therebetween, such as left inflow air, right inflow air and front outflow air. In the solution, an air inlet/outlet 1022 at the same position is provided on a casing 102 on an outer side of a centrifugal volute 104. That is, an air outlet 1022 and a primary air inlet 1024 are both provided on a circumferential side wall of the casing 102. During production, the casing 102 having the air outlet 1022 and the primary air inlet 1024 may be produced merely by machining the circumferential side wall of the casing 102. A curvature of a contour of an air duct outlet 1042 at a bottom is less than that at a top.

A filter screen structure 108 is arranged on at least one of the primary air inlet 1024 and an auxiliary air inlet 1026, and air quality of an indoor environment may be optimally filtered during operation of a fan, and blown air is cleaner, to improve user experience.

Further, the filter screen structure 108 may be a high efficiency particulate air (HEPA) filter screen, and impurities having a small particle size and some harmful substances in air may be filtered.

In an embodiment, a filter screen structure 108 is arranged only at the primary air inlet 1024, and the filter screen structure 108 may be arranged on an inner side of the primary air inlet 1024, or correspondingly arranged on an outer side of the primary air inlet 1024.

In another embodiment, a filter screen structure 108 is arranged only at an auxiliary air inlet 1026, and the filter screen structure 108 may be arranged on an inner side of the auxiliary air inlet 1026, or correspondingly arranged on an outer side of the auxiliary air inlet 1026.

In another embodiment, a filter screen structure 108 is arranged at both a primary air inlet 1024 and an auxiliary air inlet 1026.

It may be understood that the filter screen structure 108 is arranged on an outer side of an air passing cover 107, to facilitate operation when replacement is required. It may be understood that the filter screen structure 108 belongs to a consumable structure. After a product operates for a period of time, a large amount of filtered dust may be accumulated on the filter screen structure 108, and the filter screen structure needs to be replaced. In the solution, the filter screen structure 108 is arranged on the outer side of the air passing cover 107 and is arranged corresponding to the primary air inlet 1024, may be replaced by a user conveniently and rapidly.

On the basis of any one of the embodiments described above, a mounting recess 1102 is provided on the air passing cover 107. A position of the mounting recess 1102 is a position corresponding to the primary air inlet 1024 on the circumferential side wall of the air passing cover 107, and the mounting recess is provided on a radial outer side of the primary air inlet 1024. On this basis, by arranging a cover plate grid 1104, the cover plate grid 1104 is grid-shaped, and air may circulate normally, and the filter screen structure 108 may be limited and fixed. In some embodiments, since the cover plate grid 1104 is detachably connected to the mounting recess 1102, the filter screen structure 108 is convenient to replace.

It may be understood that detachable connection between the cover plate grid 1104 and the mounting recess 1102 includes, but not limited to, clamping, threaded connection, magnetic connection, etc.

Further, an outer plate 112 is arranged outside an axial direction of the casing 102, and a preliminary scattering effect on inflow air can be achieved, and inflow of air is more uniform. In a further embodiment, an outer air inlet 1122 is provided on the outer plate 112, and the outer air inlet 1122 is provided in a hole shape. Under the condition that the centrifugal fan 106 operates, air flows through the outer air inlet 1122 and flows into the centrifugal fan 106 through the auxiliary air inlet 1026, to complete air inflow.

It may be understood that a position of the outer air inlet 1122 corresponds to a position of the auxiliary air inlet 1026. A specific corresponding relation includes, but not limited to, the outer air inlet 1122 and the auxiliary air inlet 1026 being provided at an interval in an axial direction.

Further, first air inlet holes 126 are circumferentially arrayed, and air around the head mechanism 100, i.e. air from all directions, may flow into the centrifugal fan by the first air inlet holes 126.

Figure 11:
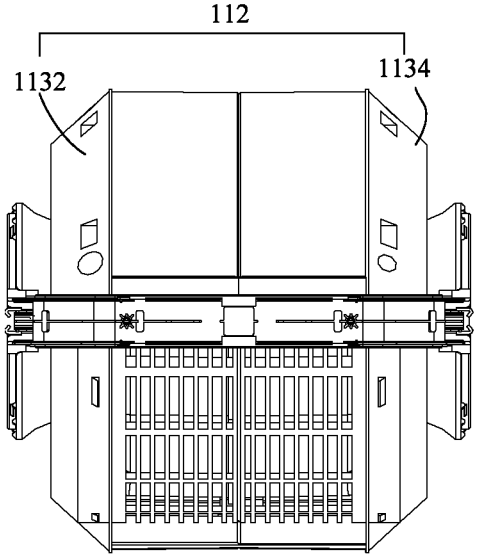
FIG. 11 shows a schematic structural diagram of a head mechanism according to an embodiment of the present application.

In a particular embodiment, as shown in FIG. 11, two outer plates 112, i.e. a first side plate 1132 and a second side plate 1134, are arranged. The two side plates are arranged outside two support covers. That is, the first side plate 1132 is arranged outside the first support cover 1032, the second side plate 1134 is arranged outside the second support cover 1034, and corresponding outer air inlets 1122 are provided on the two side plates, and air may flow from the outer air inlets 1122 on the two side plates into an auxiliary air inlet 1026 on a casing 102, to complete air inflow.

Hole diameters of first air inlet holes 126 are limited and are gradually reduced from inside to outside in a radial direction. The first air inlet holes closer to an inner side have a larger hole diameter, and the first air inlet holes closer to an outer side have a smaller hole diameter. On one hand, the first air inlet holes 126 having different hole diameters are used, and frequencies of noise sources are changed, a superposition phenomenon of a fundamental frequency is avoided, and noise may be effectively reduced. On the other hand, the first air inlet holes 126 closer to the outer side have a smaller hole diameter and a smaller air inflow amount, and the first air inlet holes 126 closer to the inner side have a larger hole diameter and a larger air inflow amount, and air inlet speeds at radial positions are as consistent as possible, to improve uniformity of inflow air.

Furthermore, the hole diameter of the first air inlet holes 126 located at the same radius on the outer plate 112 is limited. The first air inlet holes at the same radius have the same hole diameter, and on one hand, machining is facilitated, and on the other hand, when air flows to the same radius, an air inflow amount flowing through the first air inlet hole 126 is more uniform.

It may be understood that a center of the same radius is an axis around which the first air inlet holes 126 are circumferentially arrayed, which is a rotatable shaft of a centrifugal fan 106 in general.

In a particular embodiment, an outer plate 112 is recessed. A first air inlet hole 126 is provided on a recessed plate 1124, and impact of air during negative pressure air inlet may be effectively reduced. The recessed plate 1124 may have an effect of flow guide on air to some extent. In some embodiments, a Coanda effect is utilized, and air tends to flow along a wall surface, to improve air inflow efficiency.

A recessed direction of the recessed plate 1124 is recessed inwards, i.e., recessed towards a centrifugal volute 104. The recessed plate 1124 is a curved surface, and a process of air flowing into the first air inlet hole 126 along a surface of the recessed plate 1124 is smoother. A curved surface structure may effectively improve an air guide effect and air inflow efficiency without increasing a wind resistance.

Figure 6:
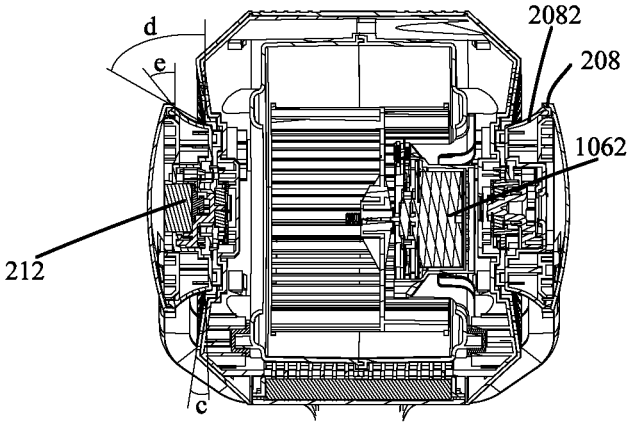
FIG. 6 shows a schematic structural diagram of an axial section of a head mechanism according to an embodiment of the present application.

As shown in FIG. 6, an included angle c between an outer wall surface of a recessed plate 1124 and a vertical direction is limited to be less than 30°. A recessed angle of the recessed plate 1124 is small, and a steering direction of air is gentle, to reduce possibility of generating noise. In some embodiments, a guide effect is more obvious, and spatial arrangement of a structure and an air guide effect on air may further be ensured.

Figure 3:
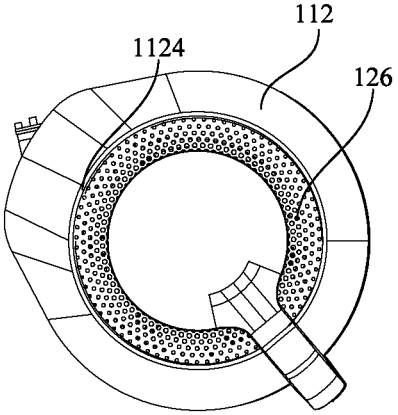
FIG. 3 shows a schematic structural diagram of a casing according to an embodiment of the present application.

As shown in FIG. 3, an auxiliary air inlet 1026 on a casing 102 is in a hole-shaped structure. That is, the auxiliary air inlet includes circumferential arrayed second air inlet holes 1028. Under the action of the second air inlet hole 1028, when air flows to the auxiliary air inlet 1026 through an outer air inlet 1122, air may be scattered for the second time, and air flowing into a centrifugal volute 104 is more sufficient and uniform.

Further, the second air inlet holes 1028 are circumferentially arrayed, and air flows into a space between the outer air inlet 1122 and the auxiliary air inlet 1026 by the first air inlet hole 126, and air from all directions may flow by the second air inlet hole 1028.

Further, each first air inlet hole 126 is provided opposite the second air inlet hole 1028.

In an embodiment, the first air inlet hole 126 and the second air inlet hole 1028 are provided in a staggered manner.

In a particular embodiment, hole diameters of second air inlet holes 1028 are limited. The second air inlet holes 1028 have the same hole diameter, and are convenient to machine. After air is scattered by the first air inlet hole 126, a difference of an air inflow amount at each radius is small, and the hole diameters of the second air inlet holes 1028 at an inner side are not changed, and the air inflow amount can be ensured.

In another particular embodiment, hole diameters of second air inlet holes are gradually reduced from inside to outside in a radial direction. The second air inlet holes closer to an inner side have a larger hole diameter, and the second air inlet holes closer to an outer side have a smaller hole diameter. On one hand, the second air inlet holes 1028 having different hole diameters are used, and frequencies of noise sources are changed, a superposition phenomenon of a fundamental frequency is avoided, and noise may be effectively reduced. On the other hand, the second air inlet holes 1028 closer to the outer side have a smaller hole diameter and a smaller air inflow amount, and the second air inlet holes 1028 closer to the inner side have a larger hole diameter and a larger air inflow amount, and air inlet speeds at radial positions are as consistent as possible, to improve uniformity of inflow air.

On the basis of any one of the embodiments described above, an auxiliary air inlet 1026 is provided on an end surface, i.e., an axial wall surface, of a casing 102, to increase an air inflow amount of a centrifugal fan 106. It may be understood that on the basis of a primary air inlet 1024, two auxiliary air inlets 1026 are additionally provided, and during air inflow, air may be inlet inwards from three directions of the casing 102, and it is more convenient to satisfy use requirements of a large air amount.

It may be understood that the auxiliary air inlet 1026 needs to be in communication with a centrifugal volute 104, to facilitate air inlet.

In the embodiment, since the primary air inlet 1024 and the air outlet 1022 are both provided in a circumferential direction of the casing 102, an effect of supplementing an inflow air amount can be achieved.

An included angle b between a straight line of one end of the air outlet 1022 close to the primary air inlet 1024 relative to a rotatable shaft of the centrifugal fan 106 and a straight line of one end of the air inlet close to the air outlet 1022 relative to the rotatable shaft of the centrifugal fan 106 are not less than 30°, and there is a gap limitation between the primary air inlet 1024 and the air outlet 1022 to some extent, and air flowing out through the air outlet 1022 may not directly return to the primary air inlet 1024, to ensure an effect of air supply.

Figure 4:
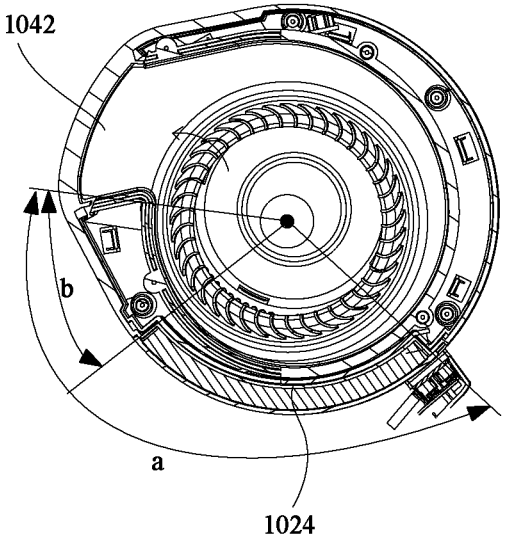
FIG. 4 shows a schematic structural diagram of a section of a head mechanism according to an embodiment of the present application.

As shown in FIG. 4, the farthest position between a primary air inlet 1024 and an air outlet 1022 is limited. That is, an angle a between one end of the air outlet 1022 close to the primary air inlet 1024 and one end of the primary air inlet 1024 farther away the air outlet 1022 relative to a rotatable shaft of a centrifugal fan 106 is not greater than 150°, to fully utilize inflow air at a position having the highest air inflow efficiency in a centrifugal volute 104, and improve air inflow efficiency.

A circumferential position of the primary air inlet 1024 is limited, and central angles corresponding to two ends of the primary air inlet are limited to be 100° to 130°, and on one hand, an air inlet resistance of the whole head mechanism can be reduced to fully utilize air at a bottom, and greatly increase an air inflow amount; and on the other hand, the primary air inlet 1024 is prevented from being too large, to ensure a position of the air outlet 1022 and an air supply distance.

In a particular embodiment, relative positions of an air outlet 1022 and a primary air inlet 1024 are limited. Under the condition that a centrifugal fan 106 normally discharges air and rotates, the air outlet 1022 is located in front of the primary air inlet 1024 in a direction of rotation of the centrifugal fan 106. That is, when the centrifugal fan rotates anticlockwise, the air outlet 1022 is located on an upper side of the primary air inlet 1024, and when the centrifugal fan rotates clockwise, the air outlet 1022 is located on a lower side of the primary air inlet 1024. Air is prevented from passing through the primary air inlet 1024, and the air outlet 1022 is provided at the primary air inlet, to improve air inflow efficiency.

In a particular embodiment, air inlet areas of two air inlets are limited. The air inlet area of the primary air inlet 1024 is limited to be larger, and the air inlet area of the auxiliary air inlet 1026 is limited to be smaller, and the primary air inlet 1024 may be fully utilized to achieve inflow of a large amount of air. In some embodiments, hidden air inflow may further be achieved according to a position of the primary air inlet 1024.

Figure 7:
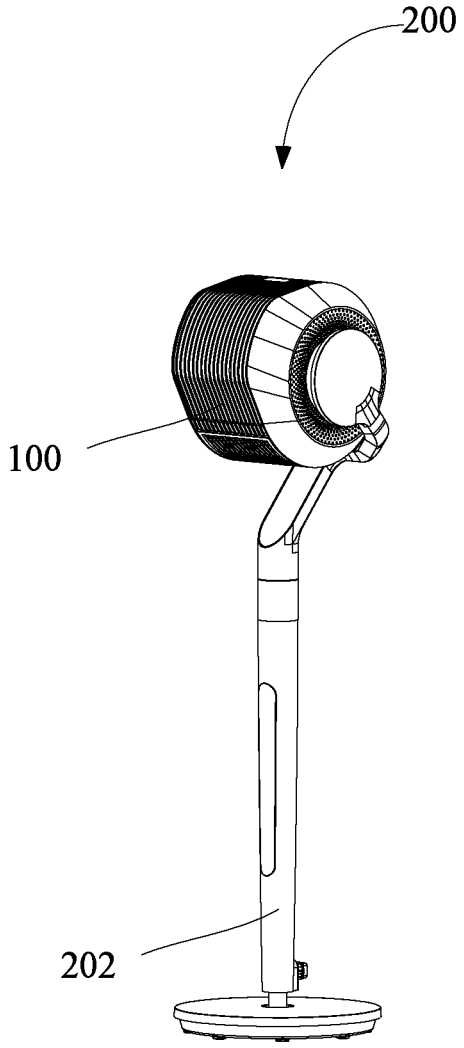
FIG. 7 shows a schematic structural diagram of a fan apparatus according to an embodiment of the present application.

As shown in FIG. 7, the embodiment provides a fan apparatus 200. The fan apparatus includes a floor stand 202 and a head mechanism 100, where the floor stand 202 may support the head mechanism 100. The fan apparatus 200 is in a shape of a floor fan as a whole, and has a height of outflow air that is in line with a use habit of a user.

It needs to be emphasized that in the present application, a guide member is formed at a top of the floor stand, and an end structure of the floor stand extending upwards is utilized to match a recessed plate on the head mechanism, and air flows into the head mechanism from a position between the end structure and the recessed plate.

Since the fan apparatus 200 includes the head mechanism 100, the fan apparatus has the beneficial effects of any one of the head mechanism 100 in the embodiment of the embodiments described above, which will not be repeated herein.

The fan apparatus 200 includes, but not limited to, a floor fan, a tower fan, a circulating fan, etc.

Further, a primary air inlet 1024 is provided on one side of a casing 102 close to the floor stand 202. That is, the primary air inlet is provided on one side of the casing 102 facing downwards to reduce appearance integrity of the fan apparatus 200 at a visible angle to the greatest extent. That is, the primary air inlet is close to a lower side of the floor stand 202 and is less likely to be observed by a user.

Figure 8:
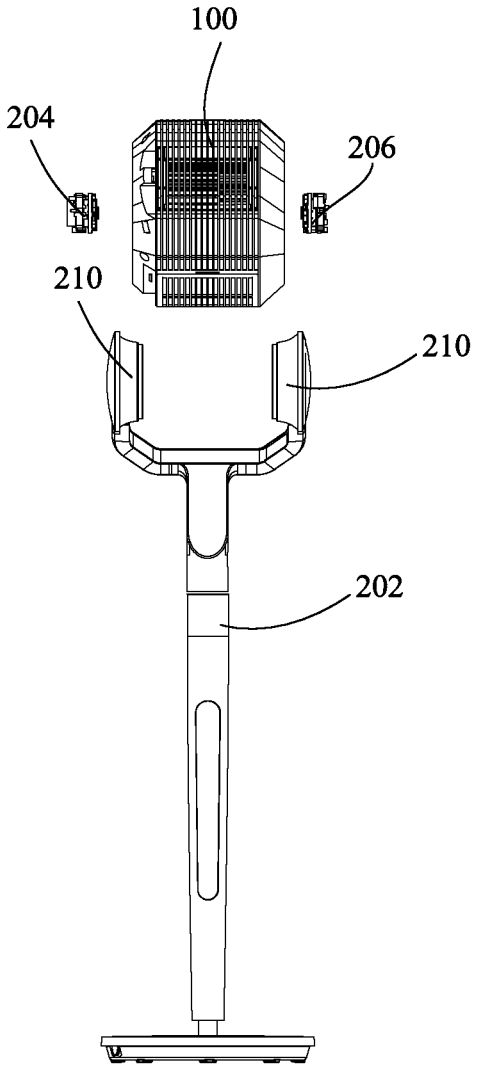
FIG. 8 shows a schematic structural diagram of a fan apparatus according to an embodiment of the present application.
Figure 10:
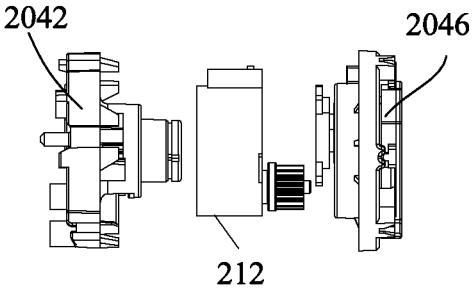
FIG. 10 shows a schematic structural diagram of a driving mechanism according to an embodiment of the present application.

In addition, as shown in FIG. 8, a driving mechanism 204 is arranged, and a head mechanism 100 can be driven to swing. For example, the head mechanism 100 can be driven to swing left and right, or the head mechanism 100 can be driven to swing in a pitching manner. As shown in FIG. 10, a driving mechanism 204 includes a first support member 2042, a rotating motor 212 and a second support member 2046. The first support member 2042 and the second support member 2046 are arranged on two sides of the rotating motor 212 respectively, the first support member 2042 is configured to be connected to a floor stand 202, and the second support member 2046 is configured to be connected to a head mechanism 100. Under the action of the rotating motor 212, the head mechanism 100 may swing relative to the floor stand 202.

It needs to be noted that at least part of the driving mechanism configured to drive the head mechanism to rotate is arranged in a guide member, and an inner space of the guide member is utilized to give consideration to both internal rotary drive and air inlet flow guide of an outer surface.

A rotating mechanism 206 is arranged on the floor stand 202, and the rotating mechanism 206 is arranged on the other side of the head mechanism 100. The rotating mechanism 206 mainly has an effect of auxiliary support, to effectively support and rotate the head mechanism 100 under the combined action of the driving mechanism 204. In some embodiments, air can be fully circulated by relative swing, to improve a purification effect.

It needs to be noted that at least part of the rotating mechanism configured to match the driving mechanism is arranged in the guide member, and the inner space of the guide member is utilized to ensure both internal rotary drive and air inlet flow guide of the outer surface.

Further, the rotating mechanism 206 and the driving mechanism 204 are arranged on two axial sides of the head mechanism 100, to adjust the head mechanism 100 in a pitching manner.

In another embodiment, as shown in FIG. 6, a guide member 208 is arranged at each of two axial ends of a head mechanism 100. Since a guide plate 2082 is arranged on the guide member 208, an air inflow space is formed under the combined action of the guide plate 2082 and a recessed plate 1124, and air flows into a casing 102 from the air inflow space.

An angle of inclination d of the guide plate 2082 relative to a vertical direction is 60° to 90°, and sufficient air can flow into an air inflow space.

Further, the guide member 208 may be directly arranged on a rotating support 210.

An inlet angle of the guide plate 2082 is limited. That is, an included angle e of a tangent of one end of the guide plate 2082 farther away the head mechanism 100 relative to the vertical direction is limited to be less than 40°, and impact of inflow air from the auxiliary air inlet 1026 can be reduced, and air inflow efficiency can be improved.

In a particular embodiment, a rotating support 210 is arranged, and a head mechanism 100 may shake and rotate. The rotating support 210 includes connectors 2102. The two connectors 2102 are arranged on two axial sides of a casing 102. The casing 102 can be rotatably connected to the rotating support 210 by the connector 2102, and pitch shaking or lateral swing of the head mechanism 100 can be achieved. On this basis, since a centrifugal fan 106 needs to be powered on, arrangement of a wire is limited to some extent when the centrifugal fan rotates. In the solution, the connector 2102 is directly utilized to make the wire extend along the connector 2102, to be led out to supply power to the centrifugal fan 106.

It needs to be noted that the rotating support 210 is Y-shaped as a whole, and a size of the head mechanism 100 cannot be greatly limited.

An auxiliary air inlet is directly provided around a rotatable shaft of the rotating support 210. That is, a first air inlet hole 126 may avoid a fulcrum position when arranged, to reduce an influence of a fulcrum on an air inflow amount, and improving air inflow efficiency.

A rotating motor 212 is arranged on the connector 2102 on one side of a casing 102, and may drive the casing 102 to rotate.

The centrifugal fan 106 includes a driving motor 1062 and an impeller 1064. The driving motor 1062 may drive the impeller 1064 to rotate, to supply air outwards. In the solution, positions of the rotating motor 212 and the driving motor 1062 are limited, and the rotating motor and the driving motor are limited to be arranged on two opposite sides of the casing 102, and a center of gravity of a whole product is close to a central axis to maintain structural stability.

Figure 9:
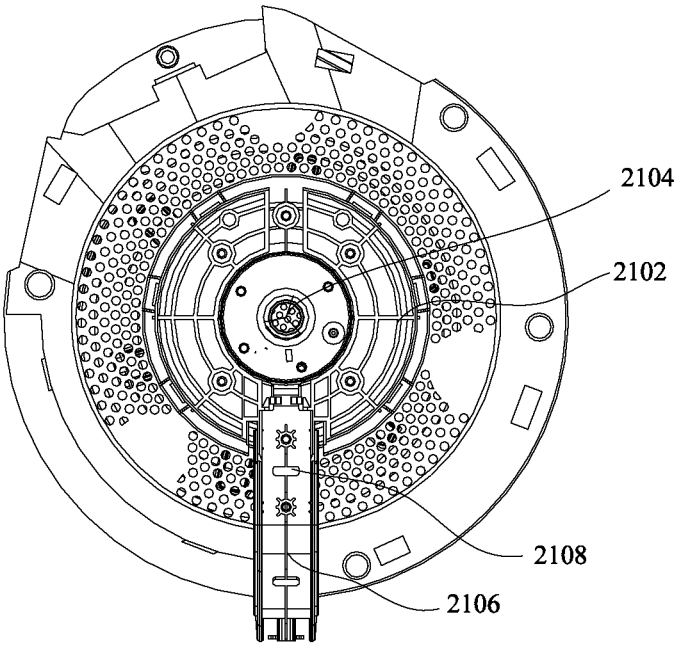
FIG. 9 shows a schematic structural diagram of a rotating support according to an embodiment of the present application.

In an embodiment, as shown in FIG. 9, a wire passing hole 2104 is provided on a connector 2102 to lead a wire of a centrifugal fan 106 out. Since a form of the wire passing hole 2104 is used, the wire can be led out from inside to outside, and then is connected to a controller or a power supply.

In another embodiment, a wire passing recess 2106 is provided on a rotating support 210, and a wire can be placed in the wire passage recess 2106. The wire passing recess 2106 provides a space for the wire and achieves structural protection, and the wires are hidden in the wire passing recess 2106 to ensure a smooth circuit.

Further, a limiting buckle 2108 is provided on the wire passing recess 2106, and the wire can be limited, and is prevented from falling into a head mechanism 100 after falling off, and use safety is improved.

In a further embodiment, if a distance between any one of the wire passing hole 2104 and the wire passing recess 2106 and a rotatable shaft of an impeller 1064 is within 200 mm, a path of the wire is closer to a center, to lead the wire out.

According to the head mechanism and the fan apparatus provided in the present application, since the primary air inlet located on the circumferential side wall is provided, inflow of air at a high flow rate can still be ensured even if the auxiliary air inlet on one side of the head mechanism is blocked, and a product has a wide applicable range.

In the present application, the terms "first", "second" and "third" are merely for descriptive purposes and should not be construed as indicating or implying relative importance; and the term "a plurality of" refers to two or more unless expressly specified otherwise. The terms "mount", "connected", "connect", "fix", etc. should be understood in a broad sense. For example, "connect" can be a fixed connection, a detachable connection, or an integrated connection; and "connected" may be a direct connection, or an indirect connection by an intermediate medium. The specific meanings of the above terms in the present application can be understood according to specific circumstances.

In the description of the present application, it should be noted that orientations or positional relations indicated by the terms "upper", "lower", "left", "right", "front", "back", etc. are based on the orientations or positional relations shown in the accompanying drawings and are merely for facilitating the description of the present application and simplifying the description, rather than indicating or implying that a device or unit referred to must have a particular orientation or be constructed and operated in a particular orientation, and therefore will not be interpreted as limiting the present application.

In the description of the present application, the description of terms "an embodiment", "some embodiments", "particular embodiments", etc. means that a specific feature, structure, material or characteristic described in combination with the embodiment or examples are encompassed in at least one embodiment or example of the present application. In the description, schematic expressions of the above terms do not necessarily refer to the same embodiment or example. Moreover, the specific feature, structure, material or characteristic described can be combined in a suitable way in any one or more embodiments or examples.

What are described above are merely the some embodiments of the present application and are not used to limit the present application, and various modifications and changes can be made to the present application. Any modifications, equivalent substitutions, improvements, etc. within the embodiments of the present application should all fall within the scope of protection of the present application.

What is claimed is:

1. A head mechanism, comprising: a casing, a primary air inlet and an air outlet are provided on a circumferential side wall of the casing, and an auxiliary air inlet is provided on an axial wall surface of the casing; and a centrifugal volute arranged in the casing, a centrifugal fan is arranged in the centrifugal volute, and an air duct outlet corresponding to the air outlet and an air duct inlet corresponding to the auxiliary air inlet are provided on the centrifugal volute; wherein air flowing from the primary air inlet and the auxiliary air inlet flows into the centrifugal volute through the air duct inlet; wherein the casing comprises: a first support cover and a second support cover, the first support cover and the second support cover are connected to form the air outlet and the primary air inlet; wherein the auxiliary air inlet is provided on an axial wall surface of the first support cover and/or an axial wall surface of the second support cover; and wherein an air passing cover sleeving an outer side of the casing, a first grid portion corresponding to the primary air inlet and/or a second grid portion corresponding to the air outlet are/is provided on the air passing cover.

2. The head mechanism according to claim 1, an extending direction of a blade of the centrifugal fan is not parallel to an extending direction of a grid of the second grid portion.

3. The head mechanism according to claim 2, the extending direction of the blade of the centrifugal fan is perpendicular to the extending direction of the grid of the second grid portion.

4. The head mechanism according to claim 1, on a section of an impeller of the centrifugal fan, a distance between the air duct outlet and a volute tongue of the centrifugal volute in a direction perpendicular to a vertical direction is less than 0.5 times a diameter of the impeller.

5. The head mechanism according to claim 1, on a section of an impeller of the centrifugal fan, a distance between a rotatable shaft of the impeller and the air duct outlet in a direction perpendicular to a vertical direction is 0.7 times to 1.3 times a diameter of the impeller.

6. The head mechanism according to claim 1, on a plane passing through a volute tongue of the centrifugal volute and one end of the air duct outlet farther from the volute tongue, a vertical distance between the air duct outlet and the plane is gradually increased from one end of the air duct outlet farther from the volute tongue to one end of the air duct outlet closer to the volute tongue.

7. The head mechanism according to claim 1, on a section of the centrifugal fan, the air duct outlet has a contour protruding outwards.

8. The head mechanism according to claim 1, the auxiliary air inlets are provided on axial wall surfaces of two ends of the casing in an axial direction respectively.

9. The head mechanism according to claim 1, the primary air inlet and the air outlet are provided at an interval in a circumferential direction of the casing, and an angle between one end of the air outlet closer to the primary air inlet and one end of the primary air inlet closer to the air outlet relative to a rotatable shaft of the centrifugal fan is not less than 30°.

10. The head mechanism according to claim 1, an angle between one end of the air outlet closer to the primary air inlet and one end of the primary air inlet farther from the air outlet relative to a rotatable shaft of the centrifugal fan is not greater than 150°.

11. The head mechanism according to claim 1, an angle between two circumferential ends of the primary air inlet relative to a rotatable shaft of the centrifugal fan is 100° to 130°.

12. The head mechanism according to claim 1, in a direction of rotation of the centrifugal fan, the air outlet is located in front of the primary air inlet.

13. The head mechanism according to claim 1, the auxiliary air inlet has an air inlet area less than that of the primary air inlet.

14. A head mechanism, comprising: a casing, a primary air inlet and an air outlet are provided on a circumferential side wall of the casing, and an auxiliary air inlet is provided on an axial wall surface of the casing; and a centrifugal volute arranged in the casing, a centrifugal fan is arranged in the centrifugal volute, and an air duct outlet corresponding to the air outlet and an air duct inlet corresponding to the auxiliary air inlet are provided on the centrifugal volute; wherein air flowing from the primary air inlet and the auxiliary air inlet flows into the centrifugal volute through the air duct inlet; and a guide member arranged at one end of the casing in an axial direction, a guide plate is arranged on one side of the guide member facing the casing, air flows into the casing by the guide plate and a recessed plate, and an included angle between the guide plate and a vertical direction is 60° to 90°.

15. The head mechanism according to claim 14, an included angle between a tangent of one end of the guide plate farther from the head mechanism and the vertical direction is less than 40°.

16. A fan apparatus, comprising: a floor stand, a guide member is formed at a top of the floor stand; and the head mechanism, comprising: a casing, a primary air inlet and an air outlet are provided on a circumferential side wall of the casing, and an auxiliary air inlet is provided on an axial wall surface of the casing; and a centrifugal volute arranged in the casing, a centrifugal fan is arranged in the centrifugal volute, and an air duct outlet corresponding to the air outlet and an air duct inlet corresponding to the auxiliary air inlet are provided on the centrifugal volute; wherein air flowing from the primary air inlet and the auxiliary air inlet flows into the centrifugal volute through the air duct inlet that is arranged on the floor stand; and a guide plate is arranged on one side of the guide member facing the casing, air flows into the casing by the guide plate and a recessed plate, and an included angle between the guide plate and a vertical direction is 60° to 90°.

17. The fan apparatus according to claim 16, further comprising:

a driving mechanism, at least part of the driving mechanism is arranged in the guide member, and the driving mechanism comprises: a first support member connected to the floor stand; and a rotating motor arranged on the first support member, a driving end of the rotating motor is connected to a second support member, and the second support member is connected to the head mechanism; and/or a rotating mechanism, at least part of the rotating mechanism is arranged in the guide member, the rotating mechanism and the driving mechanism are arranged on two opposite sides of the head mechanism in an axial direction.

18. The fan apparatus according to claim 17, a rotatable shaft of the rotating mechanism and/or the driving mechanism is located in a center of a recessed plate of the head mechanism; and a first air inlet hole of the head mechanism is provided around the rotatable shaft of the rotating mechanism.

* * * * *